US006666779B1

(12) United States Patent
Iwata et al.

(10) Patent No.: US 6,666,779 B1
(45) Date of Patent: Dec. 23, 2003

(54) GOLF CLUB AND METHOD OF MANUFACTURING THE GOLF CLUB

(75) Inventors: Mototaka Iwata, Osaka (JP); Kiyotaka Chaen, Osaka (JP); Isamu Toshinari, Osaka (JP); Kenji Kanegawa, Higashihiroshima (JP)

(73) Assignees: Mizuno Corporation, Osaka (JP); Chuo Industries, Ltd., Hiroshima (JP)

( * ) Notice: Subject to any disclaimer, the term of this patent is extended or adjusted under 35 U.S.C. 154(b) by 0 days.

(21) Appl. No.: 09/890,902

(22) PCT Filed: Feb. 2, 2000

(86) PCT No.: PCT/JP00/00577

§ 371 (c)(1),
(2), (4) Date: Aug. 2, 2001

(87) PCT Pub. No.: WO01/56666

PCT Pub. Date: Aug. 9, 2001

(51) Int. Cl.[7] ..... A63B 53/04
(52) U.S. Cl. ..... 473/350; 72/377
(58) Field of Search ..... 473/324, 349, 473/350; 72/356, 376, 377

(56) References Cited

U.S. PATENT DOCUMENTS 3,825,991 A * 7/1974 Cornell
3,901,692 A * 8/1975 Mikawa
5,423,535 A * 6/1995 Shaw
5,911,948 A * 6/1999 Ratka
2002/0016218 A1 2/2002 Takeda

FOREIGN PATENT DOCUMENTS

| | | | |
|---|---|---|---|
| JP | 03267077 | 11/1991 | ..... A63B/53/04 |
| JP | 09103523 | 4/1997 | |
| JP | 2814666 B2 * | 10/1997 | |
| JP | 10071219 | 3/1998 | |

OTHER PUBLICATIONS

Mechanical Materials Science, Feb. 1998; pp. 62 and 63, Great China Books Corporation cited within action by Taiwanese Patent Office dated Oct. 11, 2001.
Supplementary International Search Report dated May 17, 2002.
International Search Report.

* cited by examiner

*Primary Examiner*—Stephen Blau
(74) *Attorney, Agent, or Firm*—Troutman Sanders LLP; Gerald R. Boss; Ryan A. Schneider

(57) ABSTRACT

A golf club according to the present invention comprises a face portion (1) and a neck portion (2), and metal flow lines (3) continue from the face portion (1) to the neck portion (2). These metal flow lines (3) extend in a single direction on the face portion (1). A method of manufacturing a golf club according to the present invention comprises steps of bending a rod member subjected to drawing plastic working on an end and forging the rod member after the bending for integrally molding a face portion (1) and a neck portion (2).

15 Claims, 17 Drawing Sheets

(3 of 17 Drawing Sheet(s) Filed in Color)

GOLF CLUB AND METHOD OF MANUFACTURING THE GOLF CLUB

TECHNICAL FIELD

The present invention relates to a golf club and a method of manufacturing the same, and more specifically, it relates to a structure of a golf club head formed by integrally forming a face portion and a neck portion and a method of manufacturing the same.

BACKGROUND TECHNIQUE

The head part of a golf club includes a face portion having a stroking surface and a neck portion connecting this face portion with a shaft. While the face portion and the neck portion are integrally formed in a golf club head manufactured by forging in general, the neck portion is so readily deformed in stroking that the neck portion must be thickened and it is difficult to reduce mass distribution to the neck portion. Further, the face portion and the neck portion are formed in different steps respectively and thereafter connected with each other. Therefore, strength on the connected parts of the face portion and the neck portion is disadvantageously reduced.

To this end, the inventors have made deep study on the reason therefor, to recognize that metal flow lines discontinue on the aforementioned connected parts. They have further investigated metal flow lines in various conventional products, to find those shown in FIGS. 20 to 24. In a golf club head shown in these figures, metal flow lines 3 partially continue on connected parts of a face portion 1 and a neck portion 2, and hence it is inferable that strength on the connected parts improves.

Also in this example, however, the metal flow lines 3 are toward various directions on the face portion 1 as shown in FIG. 21, and get inhomogeneous on the face portion 1. Therefore, hardness of the face portion 1 gets so inhomogeneous as shown in FIG. 25 that strength varies with portions of the face and the thickness of the face must be designed in response to a portion inferior in strength and disadvantageously hard to reduce.

DISCLOSURE OF THE INVENTION

The present invention has been proposed in order to solve the aforementioned problem. An object of the present invention is provide a golf club having a wide sweet spot by rendering metal flow lines continuously extend over a neck portion and a face portion and rendering the metal flow lines extend in a single direction on the face portion thereby homogenizing hardness of the face portion while improving strength on the aforementioned connected parts and reducing the thickness of the face or reducing the diameter of the neck for applying residual mass thereof to a portion around the head.

The golf club according to the present invention comprises a face portion having a stroking surface (ball hitting surface) and a neck portion connecting the face portion with a shaft, and metal flow lines (grain flows) continue from the neck portion to the face portion while the metal flow lines extend in a single direction on the face portion.

The metal flow lines thus continue from the neck portion to the face portion, whereby strength on the connected parts of the neck portion and the face portion can be improved. Further, the metal flow lines extend in a single direction on the face portion, whereby hardness of the face portion can be homogenized.

The aforementioned metal flow lines preferably extend in the aforementioned single direction on the stroking surface. Further, the metal flow lines preferably extend along a plane parallel to the stroking surface. In addition, the metal flow lines preferably extend from the neck portion in a direction toward a toe of the face portion.

The difference between the maximum value and the minimum value of Vickers hardness ((Hv) with a load of 2 kg) on a stroking portion of the aforementioned face portion is preferably not more than 30. Vickers hardness on the stroking portion is preferably at least 130 and not more than 160. More preferably, Vickers hardness on the stroking portion is at least 140 and not more than 160. The stroking portion refers to a surface portion of the face portion reaching a prescribed depth from the stroking surface, which is a portion planned to stroke from the first.

The golf club according to the present invention comprises a face portion and a neck portion integrally formed by bending a rod member reduced in sectional area by drawing plastic working and thereafter forging the rod member.

The inventors have recognized that a golf club manufactured by the aforementioned method attains the aforementioned excellent effect.

A method of manufacturing a golf club according to the present invention comprises the following steps: A rod member reduced in sectional area by drawing plastic working is subjected to bending. After this bending, the rod member is subjected to forging for integrally forming a face portion and a neck portion.

Metal flow line density of a portion for defining the neck portion can be improved in the rod member, for example, by performing drawing plastic working in the aforementioned manner. The rod member can be bent while keeping the metal flow lines effective by performing bending on the rod member in this state. The face portion and the neck portion can be integrally formed while keeping the metal flow lines effective to the maximum by forging the bent rod member.

The aforementioned drawing plastic working is preferably performed to plastically work a first end of the rod member to be smaller in sectional area than a second end while increasing metal flow line density on the first end of the rod member. The aforementioned drawing plastic working may be performed by rolling an end of the rod member, for example.

The aforementioned forging step preferably includes a first forging step of performing rough forging on the rod member a plurality of times for approximating the shape of the rod member to a final shape while ensuring metal flow lines and a second forging step of performing precision forging on a material obtained after the rough forging for working the material into the final shape. Thus, forging can be performed while keeping the metal flow lines effective.

The neck portion is formed on a first end of the rod member subjected to drawing plastic working, and the face portion is formed on a second end of the rod member.

BRIEF DESCRIPTION OF THE DRAWINGS

The file of this patent contains at least one drawing executed in color. Copies of this patent with color drawing(s) will be provided by the Patent and Trademark Office upon request and payment of the necessary fee.

BEST MODE FOR CARRYING OUT THE INVENTION

An embodiment of the present invention is now described with reference to FIGS. 1 to 19.

Figure 1:
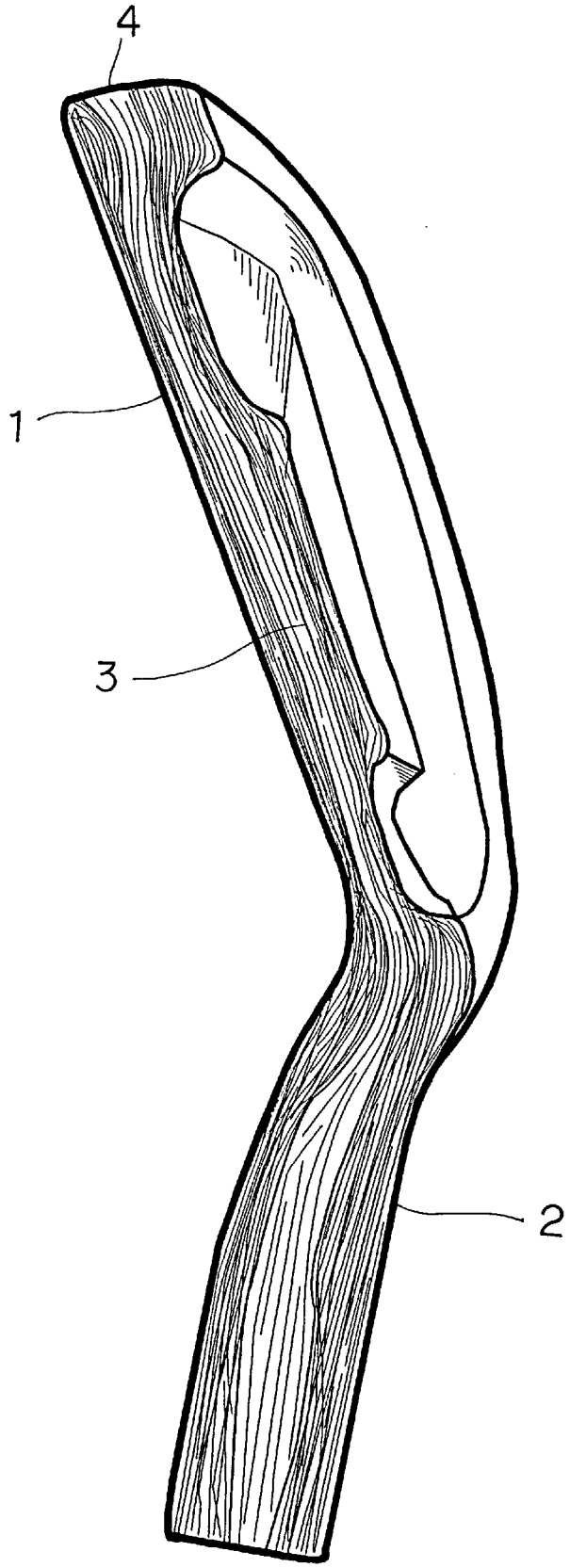
FIG. 1 is a sectional view of a golf club head according to the present invention along a direction perpendicular to a stroking surface.
Figure 2:
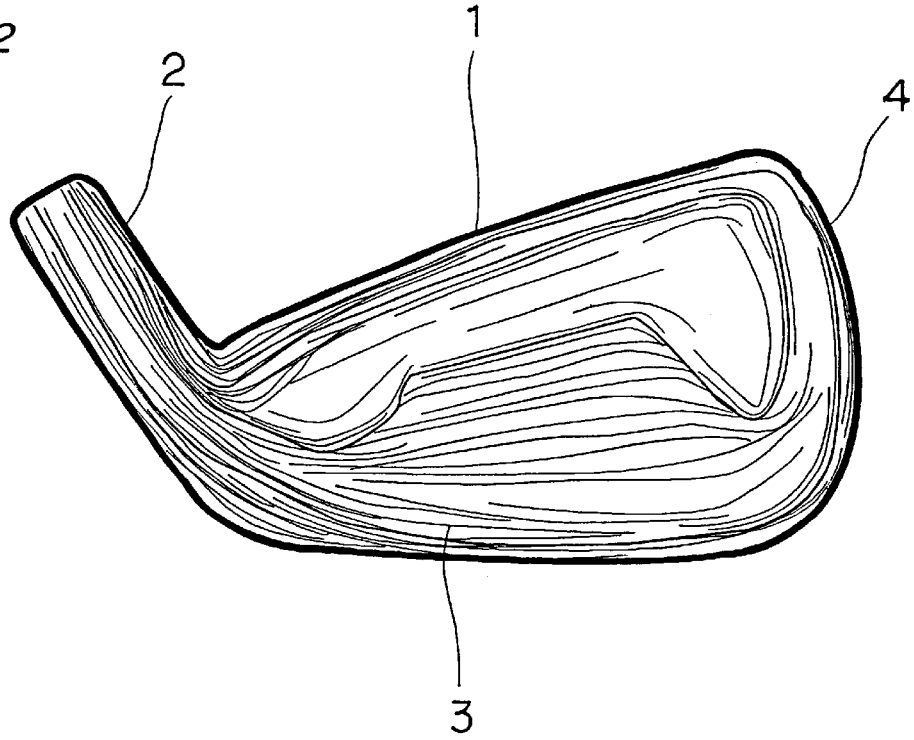
FIG. 2 is a sectional view of the golf club head according to the present invention along a direction parallel to the stroking surface.
Figure 3:
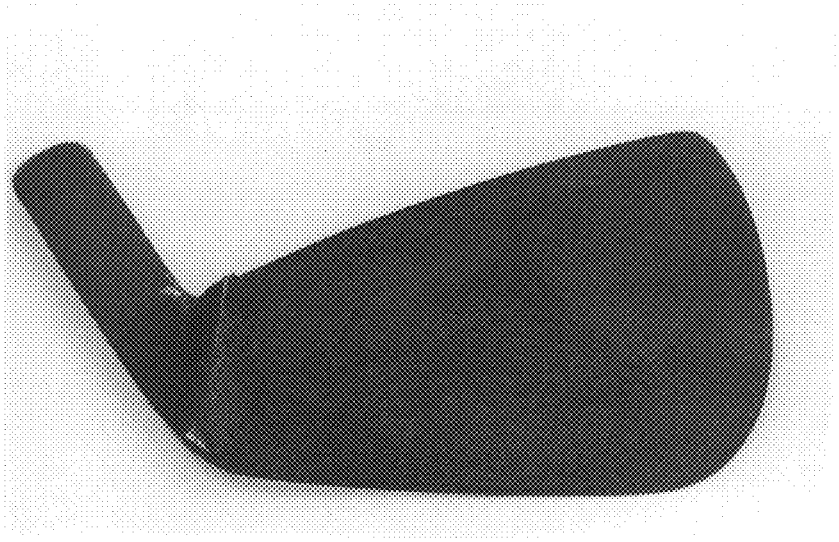
FIG. 3 is a photograph showing a sectional structure of the golf club head according to the present invention along the direction parallel to the stroking surface.
Figure 4:
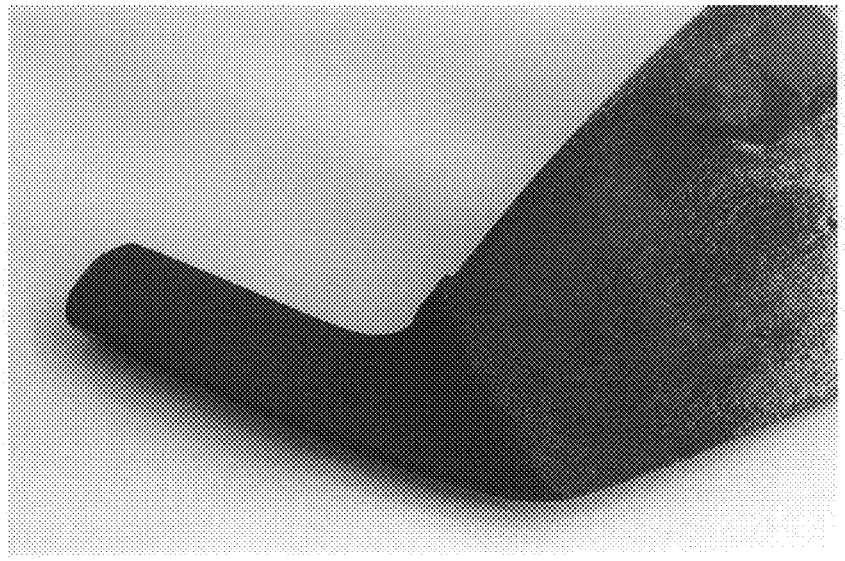
FIG. 4 is a photograph showing a sectional structure of a neck portion in the golf club head according to the present invention.
Figure 5:
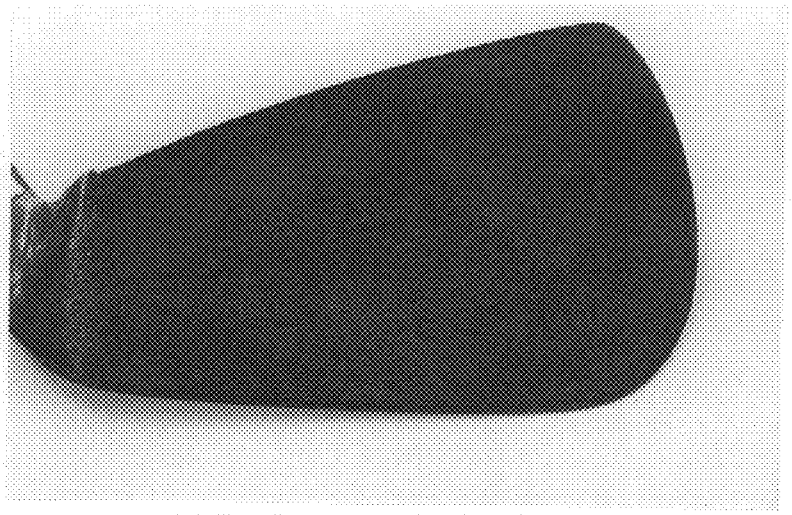
FIG. 5 is a photograph showing a sectional structure of a face portion in the golf club head according to the present invention.
Figure 22:
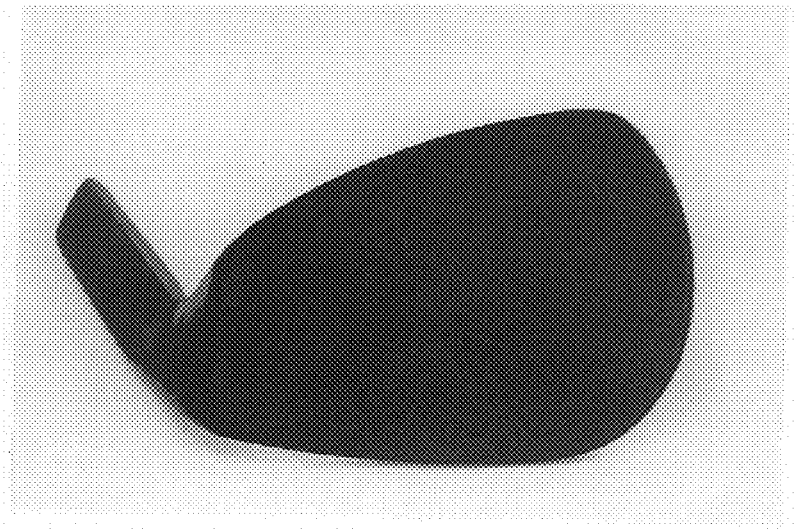
FIG. 22 is a photograph showing a sectional structure of the conventional golf club head along the direction parallel to the stroking surface.

FIGS. 1 and 2 are sectional views of a head portion in a golf club according to the present invention. FIGS. 3 to 5 are photographs showing a sectional structure of the aforementioned head portion.

As shown in FIGS. 1 to 5, the golf club according to the present invention comprises a face portion 1 having a stroking surface and a neck portion 2 connecting this face portion 1 with a shaft. Metal flow lines 3 continue from the neck portion 2 to the face portion 1, and a majority of these metal flow lines 3 extend in a single direction on the face portion 1. More specifically, most parts of the metal flow lines 3 continuously extend from the neck portion 2 toward a toe 4 of the face portion 1.

The metal flow lines 3 continue from the neck portion 2 to the face portion 1 as described above, whereby strength on the connected parts of the face portion 1 and the neck portion 2 can be improved. In addition, the majority of metal flow lines 3 extend in the aforementioned single direction on the face portion 1, whereby hardness on the face portion 1 can be substantially homogenized.

Figure 6A:
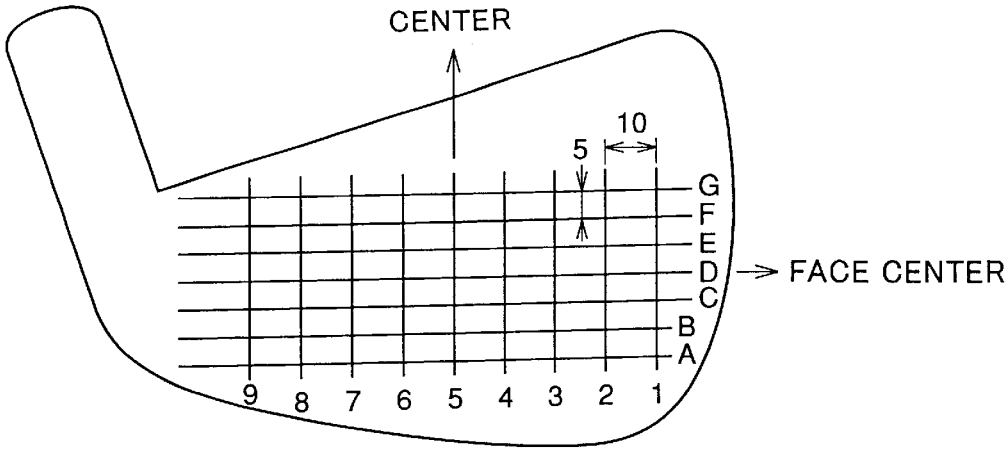
FIG. 6A is a diagram showing hardness measuring positions on the face portion of the golf club head according to the present invention.
Figure 7A:
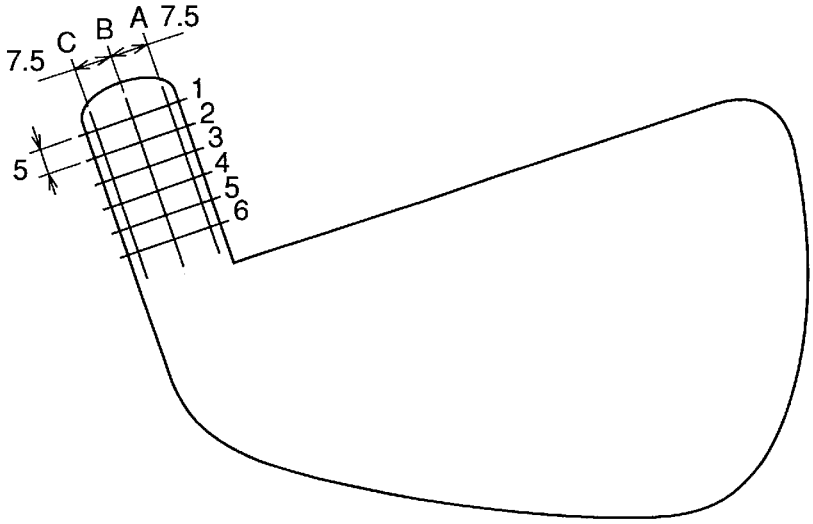
FIG. 7A is a diagram showing hardness measuring positions on the neck portion of the golf club head according to the present invention.
Figure 6B:
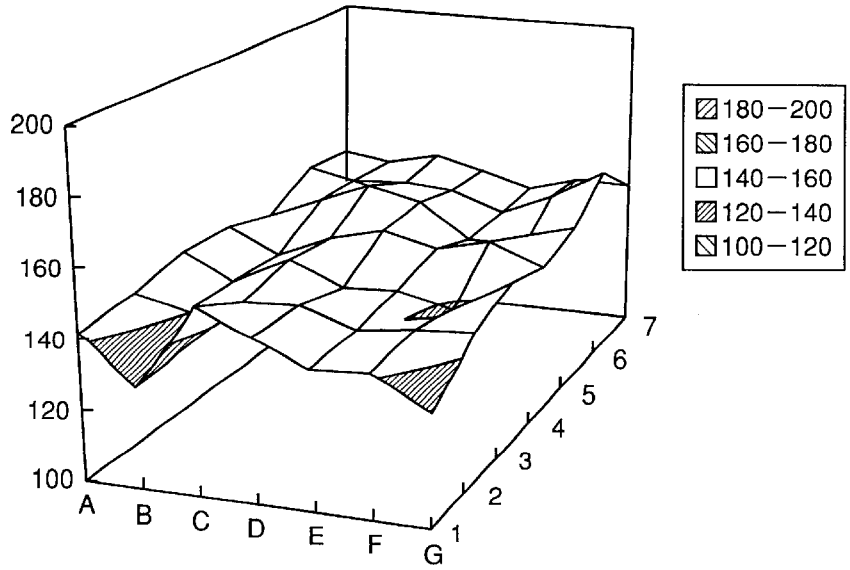
FIG. 6B is a diagram showing hardness measurement results on the face portion of the golf club head according to the present invention.

In order to confirm such an effect, the inventors have compared Vickers hardness ((Hv) with a load of 2 kg) on stroking portions of the face portions 1 in the inventive and conventional golf clubs. More specifically, they have compared Vickers hardness on cutting planes in the case of cutting the face portions 1 along planes substantially parallel to the stroking surfaces. FIG. 6B, Table 1, FIG. 25 and Table 2 show the results. FIG. 6A shows Vickers hardness measuring positions.

TABLE 1

Invention: Vickers Hardness of Face Portion

| | A | B | C | D | E | F | G |
|---|---|---|---|---|---|---|---|
| 1 | 142 | 129 | 153 | 147 | 140 | 141 | 133 |
| 2 | 144 | 140 | 145 | 146 | 141 | 143 | 144 |
| 3 | 148 | 140 | 149 | 142 | 143 | 139 | 148 |
| 4 | 147 | 140 | 147 | 151 | 147 | 151 | 144 |
| 5 | 143 | 149 | 156 | 152 | 141 | 139 | 148 |
| 6 | 151 | 148 | 149 | 148 | 142 | 149 | 158 |
| 7 | 149 | 147 | 151 | 147 | 142 | 147 | 146 |

TABLE 2

Prior Art: Vickers Hardness of Face Portion

| | A | B | C | D | E | F | G |
|---|---|---|---|---|---|---|---|
| 1 | 138 | 142 | 164 | 157 | 171 | 176 | 177 |
| 2 | 143 | 135 | 151 | 146 | 167 | 173 | 172 |
| 3 | 157 | 143 | 133 | 155 | 150 | 160 | 170 |
| 4 | 159 | 136 | 138 | 132 | 142 | 149 | 155 |
| 5 | 143 | 139 | 136 | 135 | 138 | 149 | 141 |
| 6 | 138 | 143 | 135 | 141 | 137 | 134 | 141 |
| 7 | 135 | | | | | 132 | 135 |

Figure 25:
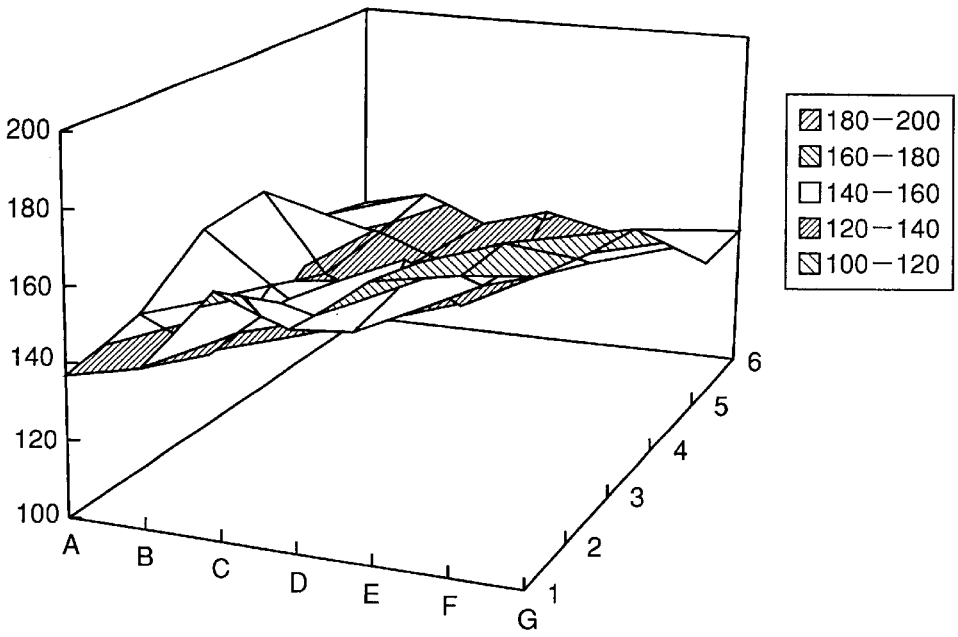
FIG.25 PRIOR ART
FIG. 25 illustrates hardness measurement results on the face portion of the conventional golf club head.

While Vickers hardness is substantially homogeneous in the range of about 130 to about 160 (about 140 to about 160 at the center of the face position 1) in the present invention as shown in FIG. 6B and Table 1, it is understood that dispersion of Vickers hardness in the prior art is larger than that in the present invention as shown in FIG. 25 and Table 2.

In other words, it is understood that hardness on the stroking portion of the face portion 1 is more inhomogeneous in the prior art as compared with the present invention. This is inferably because the metal flow lines 3 on the face portion 1 of the prior art are inhomogeneous.

The sizes of respective crystals were regular when observing the crystal structure of the face portion 1 while the respective crystals were toward various directions when investigating crystal orientations of the respective crystals, and it has been confirmed that the face portion 1 has homogeneous composition as a result.

Figure 7B:
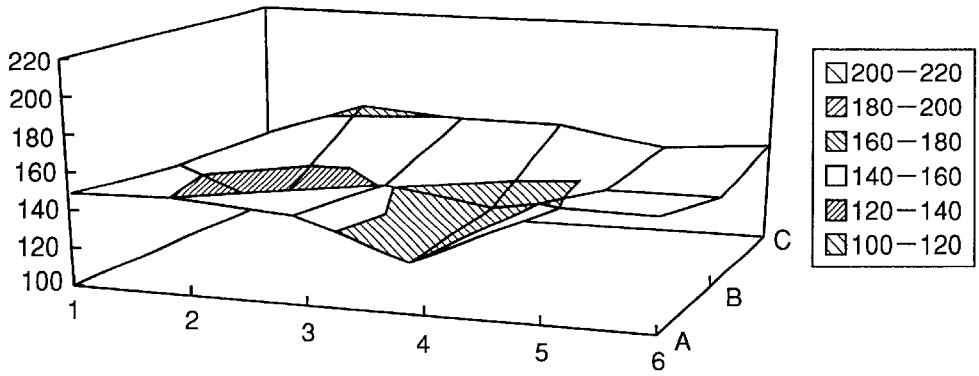
FIG. 7B is a diagram showing hardness measurement results on the neck portion of the golf club head according to the present invention.
Figure 26:
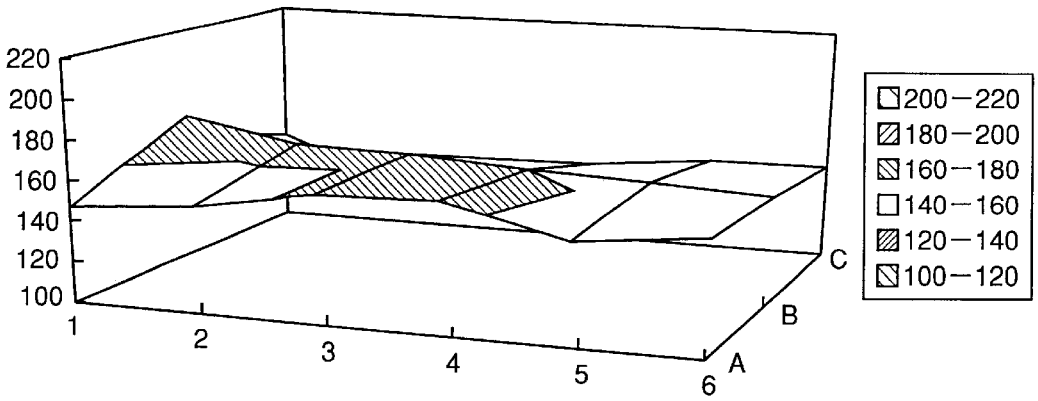
FIG.26 PRIOR ART
FIG. 26 illustrates hardness measurement results on the neck portion of the conventional golf club head.

Hardness was measured also on the neck portions 2 of the golf clubs, and the results are now described. FIG. 7B and Table 3 show Vickers hardness measurement results on the neck portion 2 of the inventive golf club. FIG. 26 and Table 4 show Vickers hardness measurement results on the neck portion 2 of the conventional golf club. The measurement results shown in these figures and tables are results on positions shown in FIG. 7A.

TABLE 3

| Invention: Vickers Hardness of Neck Portion | | | |
|---|---|---|---|
| | A | B | C |
| 1 | 149 | 143 | 144 |
| 2 | 151 | 129 | 164 |
| 3 | 147 | 141 | 159 |
| 4 | 128 | 131 | 159 |
| 5 | 161 | 146 | 150 |
| 6 | 160 | 146 | 154 |

TABLE 4

| Prior Art: Vickers Hardness of Neck Portion | | | |
|---|---|---|---|
| | A | B | C |
| 1 | 148 | 176 | 138 |
| 2 | 152 | 165 | 138 |
| 3 | 164 | 164 | 141 |
| 4 | 165 | 160 | 142 |
| 5 | 151 | 157 | 149 |
| 6 | 157 | 155 | 150 |

As shown in the aforementioned FIG. 7B, Table 3, FIG. 26 and Table 4, it is understood that the hardness of the neck portion 2 of the inventive golf club is slightly higher than the hardness of the face portion 1 of the inventive golf club although slightly lower than the prior art. This is inferably because a portion for defining the neck portion 2 was rolled in a material for improving the density of the metal flow lines 3 as described later.

Referring again to FIG. 1, a majority of metal flow lines 3 continuously extend in a single direction (the direction from the neck portion 2 toward the toe 4) at least on the stroking surface of the face portion 1 and in the vicinity thereof. In other words, the majority of metal flow lines 3 extend in the aforementioned single direction in a layered manner along the smoking surface of the face portion 1.

As hereinabove described, the golf club according to the present invention is devised to keep the metal flow lines 3 effective to the maximum over the neck portion 2 and the face portion 1. The metal flow lines 3 continue not only in the neck portion 2 and the face portion 1 but also on the surfaces thereof Thus, the hardness of the face portion 1 can be homogenized while relatively highly keeping the hardness of the neck portion 2 and the face portion 1 as described above.

A method of manufacturing a golf club according to the present invention and a sectional structure of a material in each step are now described with reference to FIGS. 8 to 19.

Figure 8:
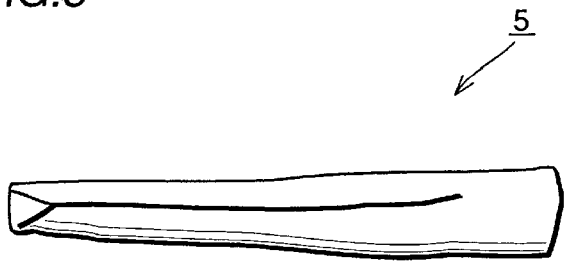
FIGS. 8 to 13B are diagrams showing first to sixth steps of manufacturing a golf club according to the present invention.
Figure 14:
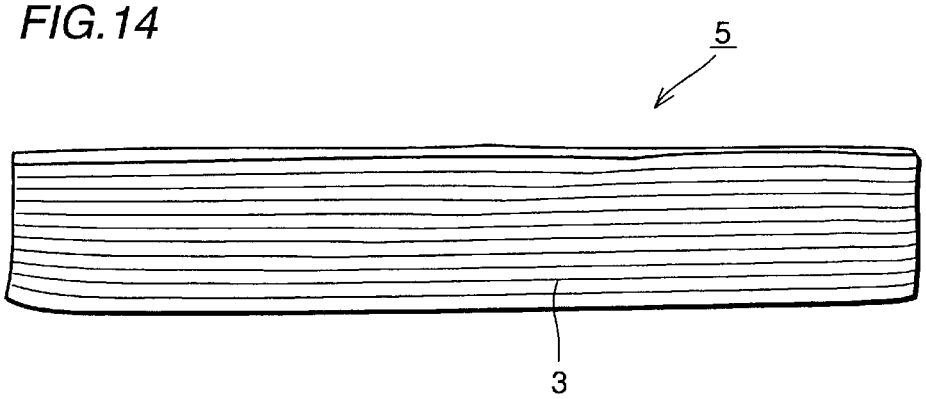
FIGS. 14 to 19 are sectional views of a material in the respective manufacturing steps according to the present invention.

First, a rod member 5 consisting of carbon steel or the like subjected to drawing plastic working for reducing the sectional area of a first end is prepared as shown in FIG. 8. This drawing plastic working can be performed by rolling the first end of the rod member 5 with a roll, for example. At this time, attention is so given that metal flow lines 3 of the rod member 5 shown in FIG. 14 are not discontinuous.

Figure 15:
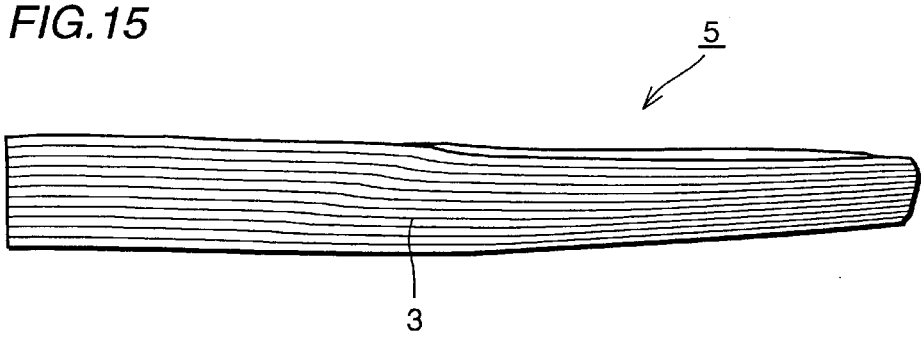

The density of the metal flow lines 3 on the first end of the rod member 5 can be improved as shown in FIG. 15 by performing drawing plastic working on the first end of the rod member 5 in the aforementioned manner. A neck portion 2 is formed on the first end while a face portion 1 is formed on a second end. Therefore, it is inferable that the density of the metal flow lines 3 on the neck portion 2 is higher than the density of the metal flow lines 3 on the face portion 1.

Processing other than the aforementioned rolling can be employed if capable of plastically working the first end of the rod member 5 and reducing the sectional area of the rod member 5.

Figure 9:
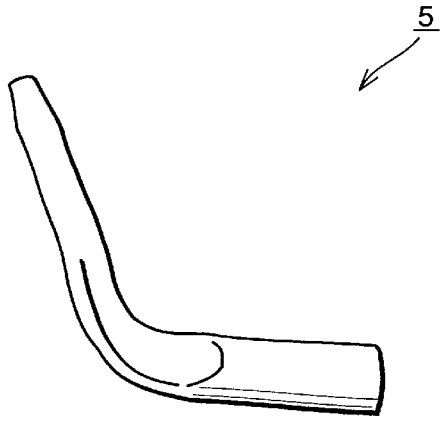
Figure 10A:
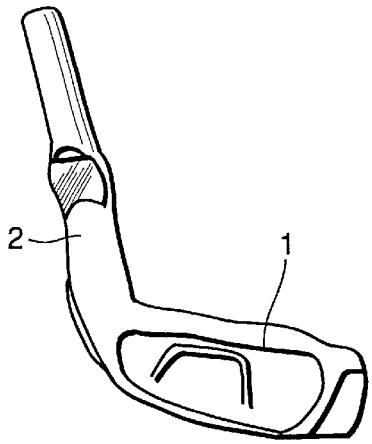
Figure 10B:
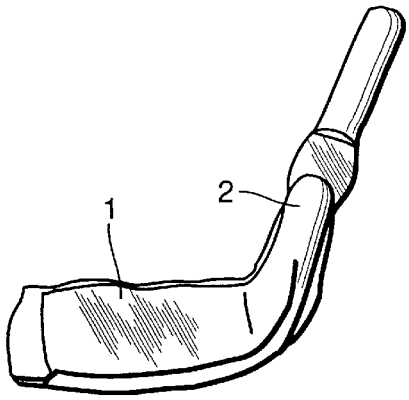
Figure 11A:
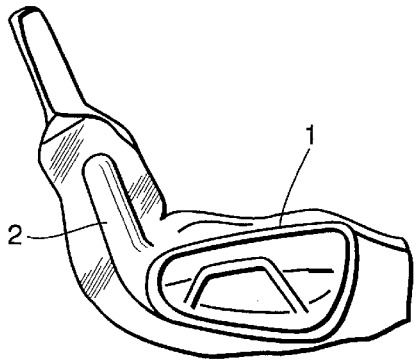
Figure 11B:
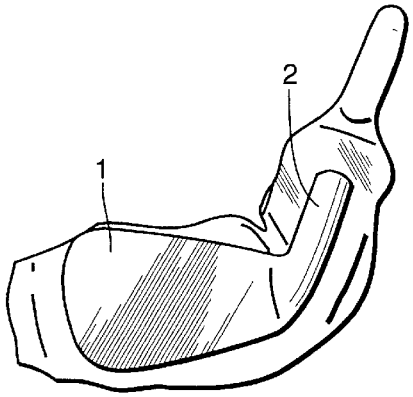
Figure 16:
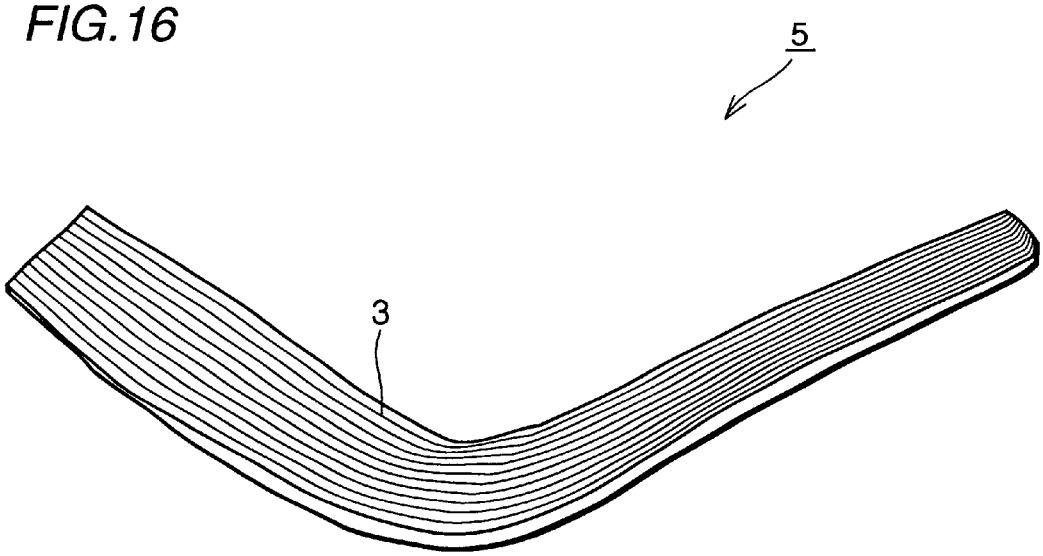

Then, the rod member 5 is bent as shown in FIGS. 9 and 16. Thereafter rough forging is performed in three stages, as shown in FIG. 10A and 10B to 12A and 12B. This rough forging is performed in a mold with a hammer of 1 ton.

Figure 17:
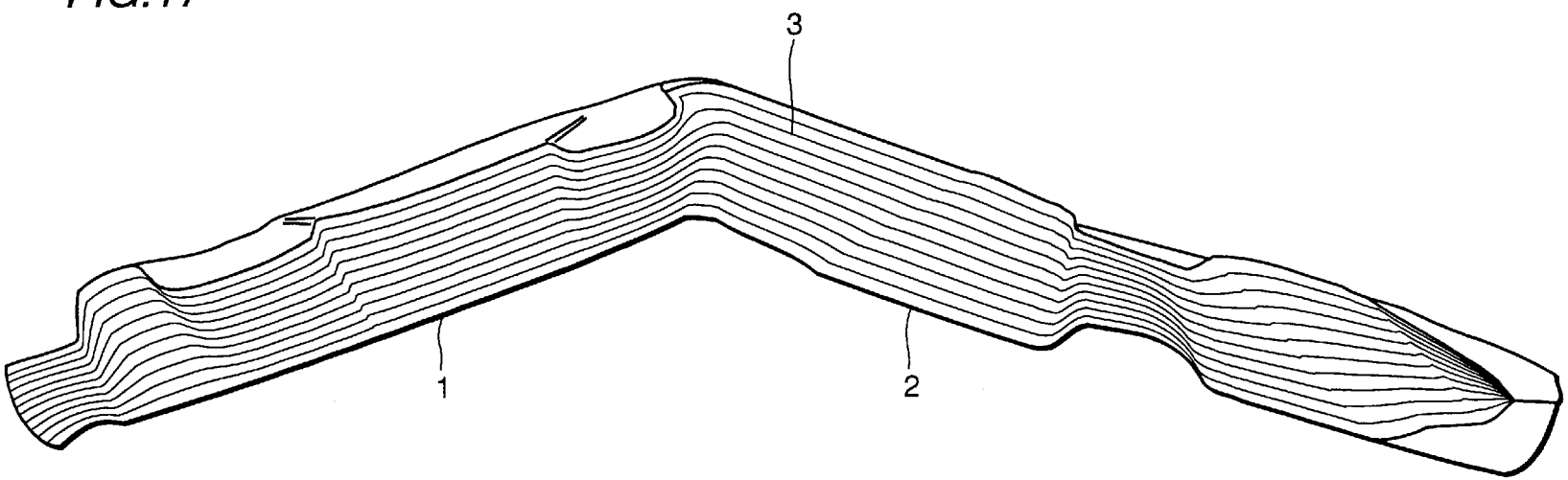
Figure 18:
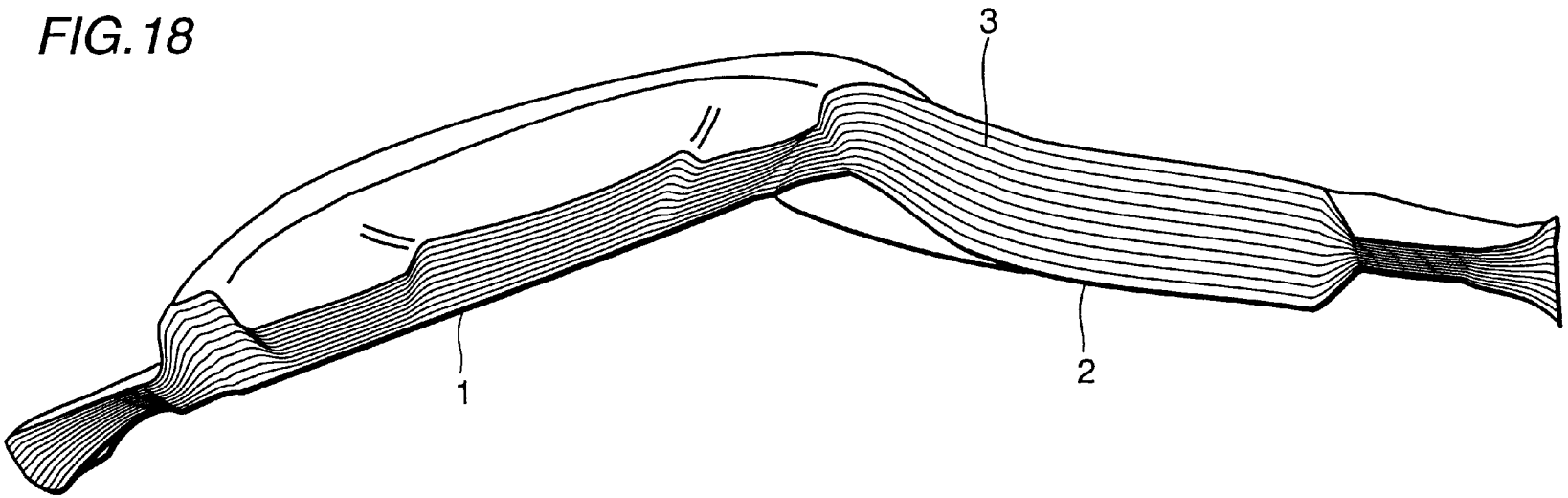
Figure 19:
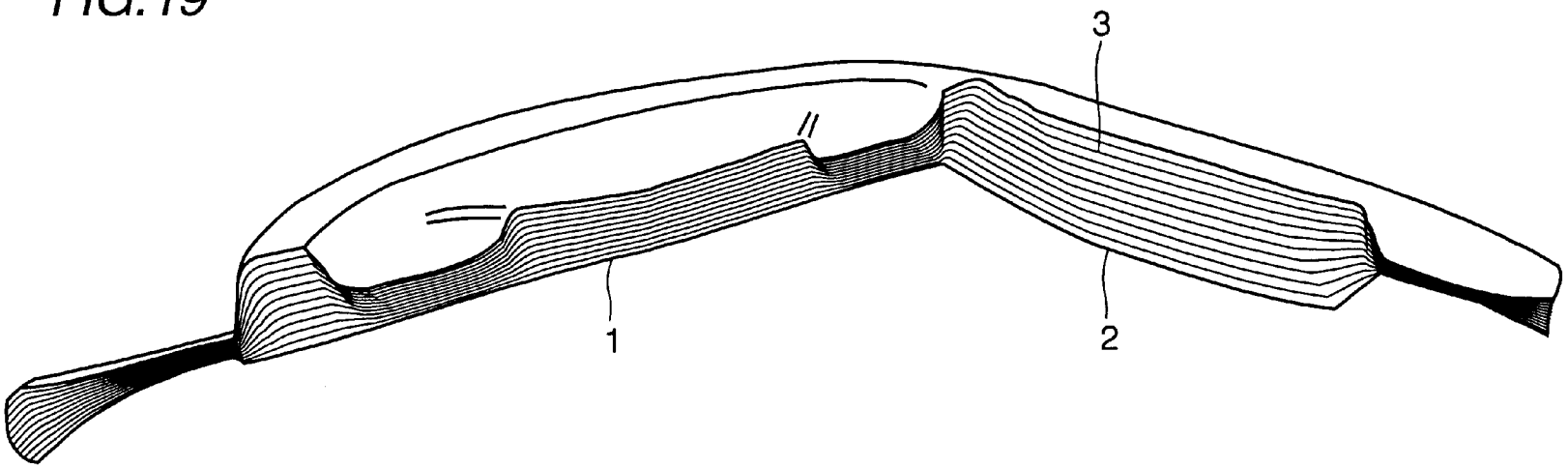
Figure 20:
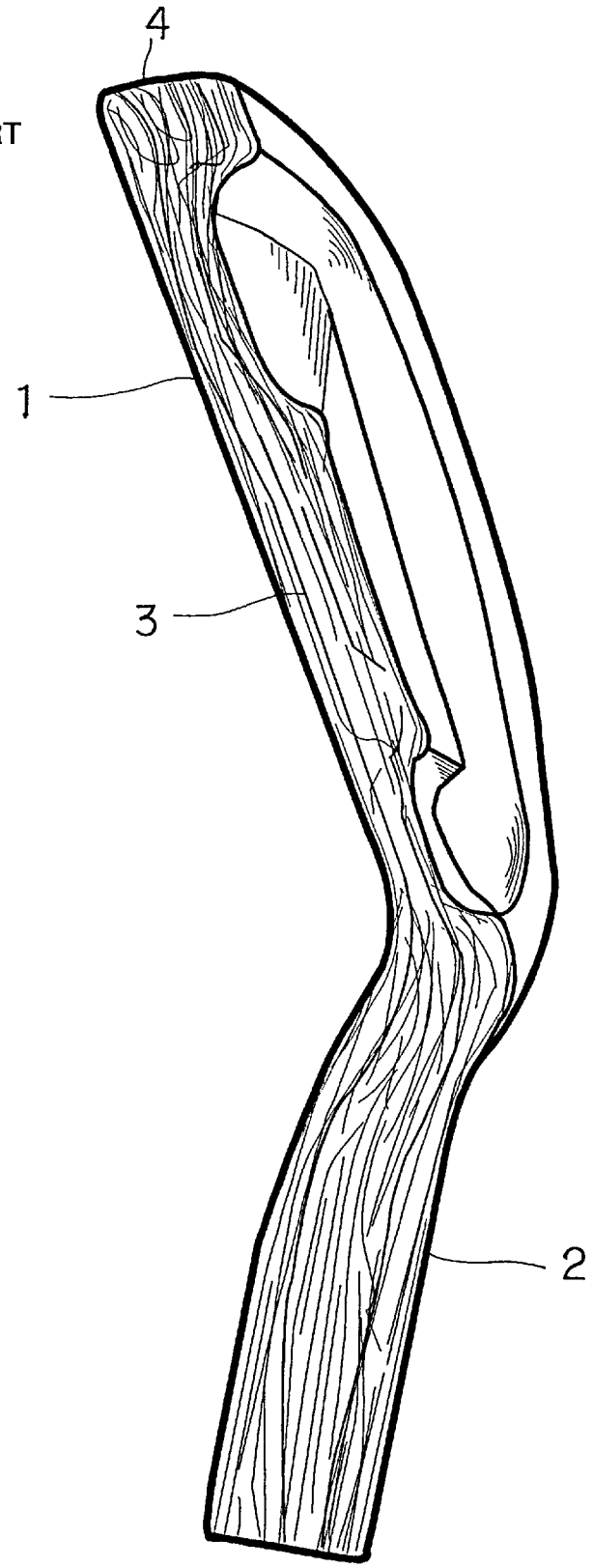
FIG. 20 PRIOR ART
FIG. 20 is a sectional view of a conventional golf club head along a direction perpendicular to a stroking surface.
Figure 21:
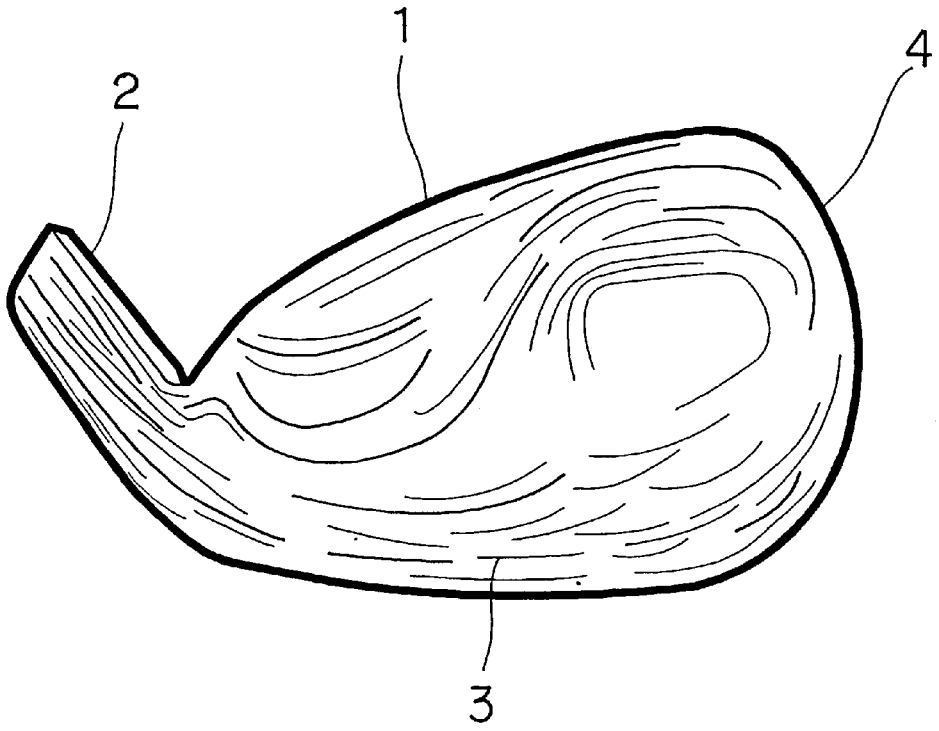
FIG. 21 PRIOR ART
FIG. 21 is a sectional view of the conventional golf club head along a direction parallel to the stroking surface.
Figure 23:
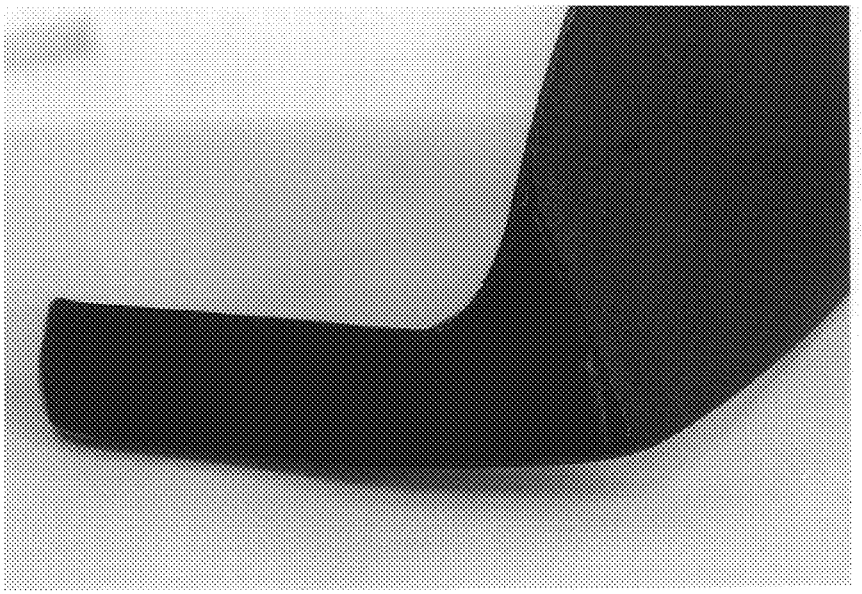
FIG. 23 is a photograph showing a sectional structure of a neck portion in the conventional golf club head.
Figure 24:
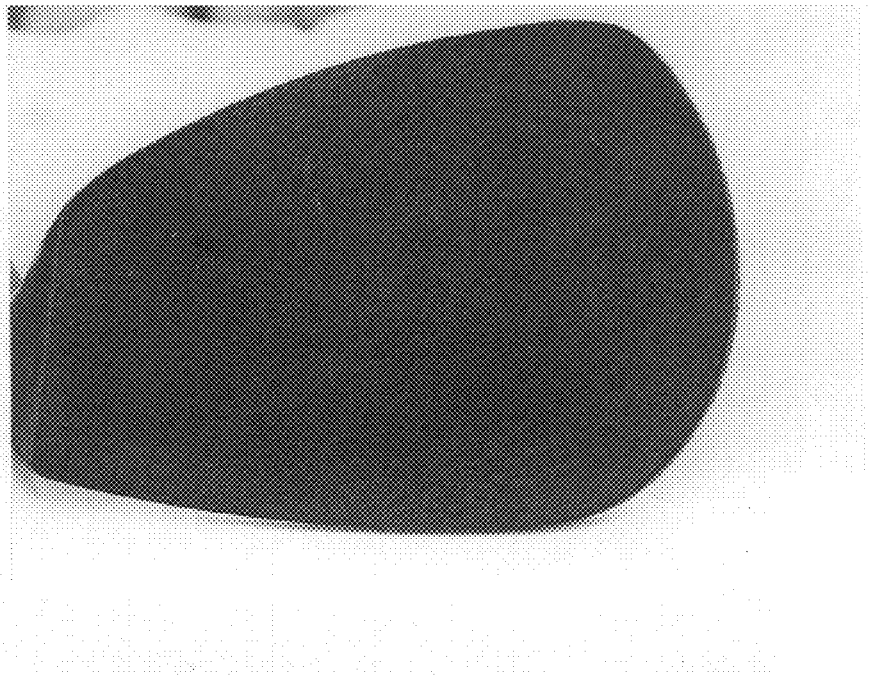
FIG. 24 is a photograph showing a sectional structure of a face portion in the conventional golf club head.

As shown in FIGS. 17 to 19, substantially complete metal flow lines 3 can be ensured in the material by plastically working the rod member 5 stepwise. More specifically, it is possible to render the metal flow lines 3 continuously extend from the neck portion 2 toward the face portion 1 while rendering these metal flow lines 3 extended along the stroking surface in a layered manner on the face portion 1.

Figure 12A:
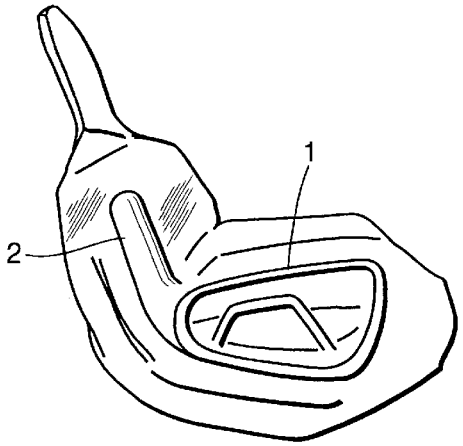
Figure 12B:
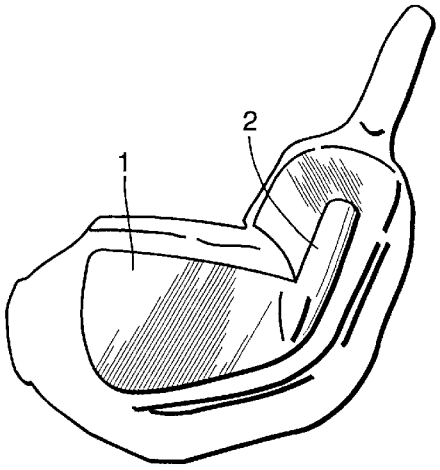

As shown in FIGS. 12A and 12B, the rod member 5 can be deformed into a shape close to a final shape due to this rough forging in three stages, whereby a final golf club head can be formed by performing only precision forging described later. Therefore, no machining may be added in a final stage but the metal flow lines 3 can be prevented from partial cutting.

Figure 13A:
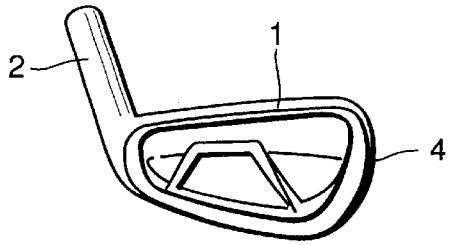
Figure 13B:
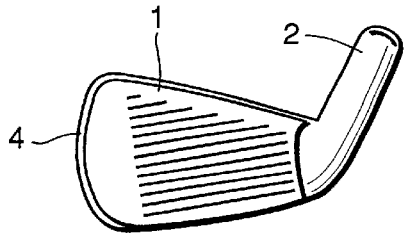

Then, trimming is performed followed by precision forging as final finishing for forming portions such as scoring lines, as shown in FIGS. 13A and 13B. It follows that a golf club head comprising the face portion 1 and the neck portion 2 integrally formed while ensuring substantially complete metal flow lines 3 is obtained through the aforementioned steps. A golf club is manufactured with this golf club head.

Although the above embodiment has been described with reference to the case of applying the present invention to an iron club, the idea of the present invention is also applicable to a face for a wood club. The face for a wood club can be manufactured by forging a material properly adjusted in diameter and length, for example.

Although the embodiment of the present invention has been illustrated as described above, the embodiment disclosed this time is to be considered illustrative in all points and not restrictive. The scope of the present invention is shown by the scope of claim for patent, and it is intended that all modifications within the meaning and range equivalent to the scope of claim for patent are included.

INDUSTRIAL AVAILABILITY

The present invention can be effectively applied to a golf club.

What is claimed is:

1. A golf club comprising:

a face portion (1) having a stroking surface; and a neck portion (2) connecting said face portion (1) with a shaft, wherein metal flow lines (3) continue from said neck portion to said face portion (1), and wherein the difference between the maximum value and the minimum value of Vickers hardness (Hv) on a stroking portion of said face portion (1) is not more than 30.

2. The golf club according to claim 1, wherein a majority of said metal flow lines (3) extend in a single direction in sad face portion.

3. The golf club according to claim 2, wherein a majority of said metal flow lines (3) extend along a plane parallel to said stroking surface.

4. The golf club according to claim 1, wherein a majority of said metal flow lines (3) extend along a direction from said neck portion (2) toward a toe (4) of said face portion (1).

5. The golf club according to claim 1, wherein the Vickers hardness on said stroking portion is at least 130 and not more than 160.

6. The golf club according to claim 1, wherein tie Vickers hardness on said stroking portion is at least 140 and not more than 160.

7. A Method of manufacturing a golf club comprising the steps of:

bending a rod member (5) reduced in sectional area by drawing plastic working; and forging said rod member (5) after said bending for integrally forming a face portion (1) and a neck portion (2);

wherein said drawing plastic working is performed to plastically work a first end of said rod member (5) to be smaller in sectional area than a second end while increasing metal flow line density on said first end of said rod member (5); and wherein the difference between the maximum value and the minimum value of Vickers hardness (Hv) on a stroking portion of said face portion (1) is not more than 30.

8. The method of manufacturing a golf club according to claim 7, wherein said forging step includes:

a first forging step of performing rough forging on said rod member (5) a plurality of times for approximating the shape of said rod member (5) to a final shape while ensuring metal flow lines (3); and a second forging step of performing precision forging on a material obtained after said rough forging for working said material into said final shape.

9. The method of manufacturing a golf club according to claim 7, forming said neck portion (2) on a first end of said rod member (5) subjected to said drawing plastic working, and forming said face portion (1) on a second end of said rod member (5).

10. A method of manufacturing a golf club comprising the steps of:

providing a face portion (1) having a stroking surface; and providing a neck portion (2) connecting said face portion (1) with a shaft;

wherein metal flow lines (3) continue from said neck portion to said face portion (1); and wherein the difference between the maximum value and the minimum value of Vickers hardness (Hv) on a stroking portion of said face portion (1) is not more than 30.

11. The method according to claim 10, wherein a majority of said metal flow lines (3) extend in a single direction in said face portion.

12. The method according to claim 10, wherein a majority of said metal flow lines (3) extend along a plane parallel to said stroking surface.

13. The method according to claim 10, wherein a majority of said metal flow lines (3) extend along a direction from said neck portion (2) toward a toe (4) of said face portion (1).

14. The method according to claim 10, wherein the Vickers hardness on said stroking portion is at least 130 and not more than 160.

15. The method according to claim 10, wherein the Vickers hardness on said stroking portion is at least 140 and not more than 160.

* * * * *